US008019516B2

(12) United States Patent
Huber

(10) Patent No.: US 8,019,516 B2
(45) Date of Patent: Sep. 13, 2011

(54) METHOD FOR MEASURING THE USEFUL LOAD OF A TELEHANDLER

(75) Inventor: Tilo Huber, Tiefenbach (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 347 days.

(21) Appl. No.: 12/345,958

(22) Filed: Dec. 30, 2008

(65) Prior Publication Data

US 2009/0183927 A1 Jul. 23, 2009

(30) Foreign Application Priority Data

Jan. 22, 2008 (DE) ..... 10 2008 000 120

(51) Int. Cl.
*B66F 17/00* (2006.01)
*B66F 9/24* (2006.01)

(52) U.S. Cl. ..... 701/50; 177/136

(58) Field of Classification Search ..... 701/50; 177/136–141

See application file for complete search history.

(56) References Cited

U.S. PATENT DOCUMENTS

| | | | | | |
|---|---|---|---|---|---|
| 2,767,394 | A | * | 10/1956 | Arnot et al. | 340/440 |
| 2,858,070 | A | * | 10/1958 | Scharff | 702/175 |
| 4,421,186 | A | * | 12/1983 | Bradley | 177/139 |
| 4,588,038 | A | | 5/1986 | Takagi | |
| 4,635,739 | A | * | 1/1987 | Foley et al. | 177/45 |
| 4,942,529 | A | * | 7/1990 | Avitan et al. | 701/50 |
| 5,067,572 | A | * | 11/1991 | Kyrtsos et al. | 177/139 |
| 5,070,953 | A | * | 12/1991 | Kyrtsos et al. | 177/25.14 |
| 5,205,514 | A | * | 4/1993 | Patzig et al. | 244/103 R |
| 6,437,701 | B1 | * | 8/2002 | Muller | 340/679 |
| 2004/0045745 | A1 | * | 3/2004 | Schiebel et al. | 177/136 |
| 2004/0200644 | A1 | * | 10/2004 | Paine et al. | 177/136 |
| 2006/0070773 | A1 | * | 4/2006 | Dahl et al. | 177/136 |
| 2006/0103336 | A1 | | 5/2006 | Brooks et al. | |
| 2007/0208476 | A1 | | 9/2007 | Baginski et al. | |

FOREIGN PATENT DOCUMENTS

| | | | |
|---|---|---|---|
| DE | 38 20 757 | A1 | 12/1989 |
| DE | 10 2006 010 291 | A1 | 9/2007 |
| GB | 2 093 598 | A | 9/1982 |
| WO | WO-89/03361 | | 4/1989 |
| WO | WO-2004/069568 | A1 | 8/2004 |

* cited by examiner

*Primary Examiner* — Randy W Gibson

(74) *Attorney, Agent, or Firm* — Davis & Bujold, P.L.L.C.

(57) ABSTRACT

A method for measuring the useful load of a telehandler including calculation of the useful load from the change of the axle load on the front axle or the rear axle compared with the vehicle in an unloaded condition, the distance of the useful load from the front axle or the rear axle having a defined value or the load-holding device of the telehandler being in a defined position.

4 Claims, 1 Drawing Sheet

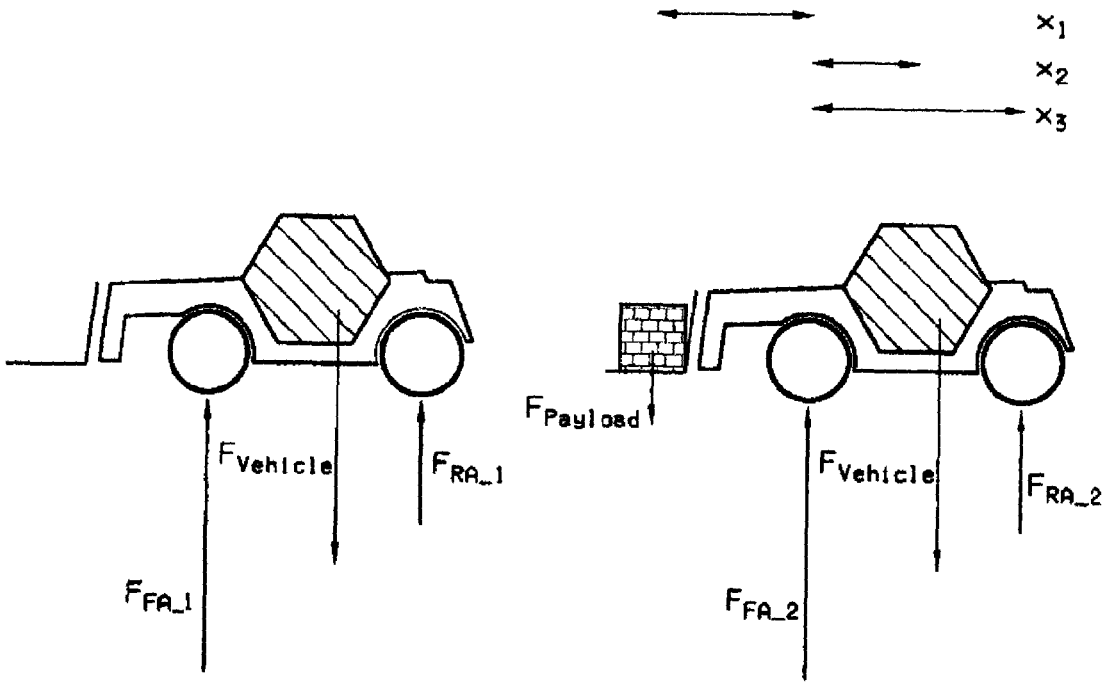
$x_1$
$x_2$
$x_3$
$F_{Vehicle}$
$F_{RA_1}$
$F_{FA_1}$
$F_{Payload}$
$F_{Vehicle}$
$F_{RA_2}$
$F_{FA_2}$

METHOD FOR MEASURING THE USEFUL LOAD OF A TELEHANDLER

This application claims priority from German Application Serial No. 10 2008 000 120.1 filed Jan. 22, 2008.

FIELD OF THE INVENTION

The present invention concerns a method for measuring the useful load of a telehandler according to the preamble of claim 1.

BACKGROUND OF THE INVENTION

Telehandlers are commonly used in agriculture, building and the storage industry, and can be in the form of forklifts, wheel loaders, mobile cranes or working platforms.

From the prior art, it is known to recognize, by way of LMI (Load Movement Indicator), critical situations in the load curve such as excessively high loading and/or a load that is too wide and to warn the driver visually and/or acoustically. For this the strain at the rear axle brackets is measured and from that the rear axle load is determined. Depending on the rear axle load, the tilt stability of the telehandler is then concluded.

From DE 10 2006 010 291 A1, a floor-level transporter or telehandler is known, which comprises an electronic memory and/or a data transfer unit, a device for collecting working data and a control unit. The latter is connected to the working data collection device and to the memory and/or data transfer unit. In the known floor-level transporter, the control unit continuously prepares from the working data collected a working protocol and stores it in the memory or sends it to the data transfer unit. The working data collection device can comprise a load sensor to determine the weight of a load, which can be integrated in the load-holding means of the floor-level transporter. Alternatively, the weight of a load can be determined from an oil pressure in the hydraulic system of the transporter.

The propose of the present invention is to indicate a method for measuring the useful load of a telehandler, such that the useful load can be measured with great accuracy without the need for a separate load sensor.

SUMMARY OF THE INVENTION

Accordingly, it is proposed to calculate the useful load from the change in the axle load on the front axle or the rear axle compared with the unloaded condition of the vehicle, with a defined distance between the useful load or load-holding device of the telehandler and the front axle or the rear axle, i.e., the load-holding device of the telehandler, which can be a scoop, a stacking fork, a gripper or a working platform, must be in a defined position.

In the distance between the useful load or load-holding device of the telehandler and the front or rear axle is kept constant, i.e., when the load-holding device is in a defined position, the useful load is proportional to the change of the axle load of the front or rear axle.

The concept according to the invention provides a method for measuring the useful load that is simple to carry out and gives accurate results. The useful load calculated can be shown by a suitable indicator device or display.

According to another embodiment of the invention, the method can be combined with LMI methods so that the useful load can be measured while at the same time critical load curve conditions can be recognized, since both methods make use of the same physical principle.

BRIEF DESCRIPTION OF THE DRAWING

The invention will now be described, by way of example, with reference to the accompanying drawings in which:

The sole FIGURE schematically illustrates the force situation in the case of an unloaded and a loaded telehandler.

DETAILED DESCRIPTION OF THE INVENTION

The left-hand side of the FIGURE shows the force situation of an unloaded telehandler. Here, the axle load $F_{FA_1}$ on the front axle is given by:

$$F_{FA_1}=F_{vehicle}-[(F_{vehicle}*x_2)/x_3]$$

where $F_{vehicle}$=weight of the vehicle, $x_2$=distance between the front axle and the vehicle's center of gravity and $x_3$=distance between the front axle and the rear axle. In the FIGURE, the axle load on the rear axle is indexed $F_{RA_1}$.

The axle load $F_{FA_2}$ on the front axle when the vehicle is loaded, as illustrated on the right in the FIGURE, is obtained as:

$$F_{FA_2}=F_{vehicle}+F_{Payload}-[(F_{vehicle}*x_2-F_{payload}*x_1)/x_3]$$

where $F_{vehicle}$=vehicle weight, $F_{Payload}$=useful load, $x_1$=distance of the useful load from the front axle, $x_2$=distance between the front axle and the vehicle's center of gravity and $x_3$=distance between the front and rear axles. The axle load on the rear axle is indexed $F_{RA_2}$.

From the above, the change $\Delta F_{FA}$ of the axle load on the front axle that results from loading is given by:

$$\Delta F_{FA}=F_{Payload}-[(F_{vehicle}*x_2-F_{payload}*x_1)/x_3]+[(F_{vehicle}*x_2)/x_3]$$

$$\Delta F_{FA}*x_3-F_{Payload}*x_3=F_{Payload}*x_1$$

and $$\Delta F_{FA}*x_3=F_{Payload}*(x_1+x_3)$$

From this, it follows that the useful load $F_{Payload}$ is:

$$F_{Payload}=\Delta F_{FA}*[x_3/(x_1+x_3)]$$

This means that when the distance $x_1$ of the useful load or the load-holding device of the telehandler from the front axle is kept constant, the useful load is proportional to the change of the axle load on the front axle so that, in this case, simple and accurate measurement of the useful load is made possible. Advantageously, a displacement of the vehicle's center of gravity that results from a useful load does not influence the calculation of the useful load in accordance with the invention.

REFERENCE NUMERALS

| | |
|---|---|
| $F_{FA_1}$ | axle load on the front axle of an unloaded vehicle |
| $F_{FA_2}$ | axle load on the front axle of a loaded vehicle |
| $F_{RA_1}$ | axle load on the rear axle of an unloaded vehicle |
| $F_{RA_2}$ | axle load on the rear axle of a loaded vehicle |
| $F_{vehicle}$ | weight of the vehicle |
| $F_{Payload}$ | useful load |
| $X_1$ | distance between the useful load and the front axle |
| $X_2$ | distance between the front axle and the vehicle's center of gravity |
| $X_3$ | distance between the front axle and the rear axle |

The invention claimed is:

1. A method of measuring a useful load of a telehandler, the method comprising the steps of:

calculating the useful load from a change of an axle load on one of the front axle or the rear axle compared with an unloaded condition of the vehicle wherein a horizontal distance of the useful load from one of the front axle and the rear axle has a defined value or a load-holding device of the telehandler is in a defined position, by calculating the useful load ($F_{Payload}$) with the equation:

$$F_{Payload}=\Delta F_{FA}*[x_3/(x_1+x_3)]$$

where $x_1$=a distance of the useful load from the front axle, $x_2$=a distance between the front axle and the vehicle's center of gravity, and $x_3$=distance between the front and rear axles and $\Delta F_{FA}$=a change of the axle load on the front axle, the distance ($x_1$) of the useful load or the load-holding device of the telehandler from the front axle being kept constant.

2. The method for measuring the useful load of a telehandler according to claim 1, further comprising the step of combining the method with load movement indicator (LMI) methods, so that the useful load can be measured and at the same time critical load curve situations can be recognized.

3. The method for measuring the useful load of a telehandler according to claim 1, further comprising the step of communicating the calculated useful load directly by one of a suitable indicator device or display.

4. A method of measuring a useful load of a telehandler, the method comprising the steps of calculating the useful load on a front axle of the telehandler when the telehandler is unloaded;

calculating the useful load on the front axle of the telehandler when the telehandler is loaded;

determining a change in the useful load on the front axle of the telehandler from when the telehandler is unloaded to when the telehandler is loaded; and calculating the useful load-($F_{Payload}$) of the telehandler with the equation:

$$F_{Payload}=\Delta F_{FA}*[x_3/(x_1+x_3)]$$

where $x_1$=a horizontal distance of the useful load from the front axle, $x_2$=a horizontal distance between the front axle and a center of gravity of the vehicle, and $x_3$=a horizontal distance between the front and rear axles and $\Delta F_{FA}$=a change of the useful load on the front axle, the horizontal distance ($x_1$) of the useful load of the telehandler from the front axle being kept constant.

* * * * *